US006916175B2

(12) United States Patent
Cho et al.

(10) Patent No.: US 6,916,175 B2
(45) Date of Patent: Jul. 12, 2005

(54) COMBUSTION GAS BURNER ENABLING MULTI-STAGE CONTROL

(75) Inventors: Seung Beom Cho, Pyungtaek-shi (KR); Hee Suk Sun, Gyonggi-do (KR); Hyun Jin Lee, Uijeongbu-shi (KR)

(73) Assignee: Kyungdong Boiler Co., Ltd., Gyonggi-do (KR)

( * ) Notice: Subject to any disclaimer, the term of this patent is extended or adjusted under 35 U.S.C. 154(b) by 0 days.

(21) Appl. No.: 10/690,326

(22) Filed: Oct. 21, 2003

(65) Prior Publication Data

US 2004/0126727 A1 Jul. 1, 2004

(30) Foreign Application Priority Data

Oct. 22, 2002 (KR) ..... 10-2002-0064501
Oct. 22, 2002 (KR) ..... 10-2002-0064495

(51) Int. Cl.[7] ..... F23D 14/62; F23D 14/08
(52) U.S. Cl. ..... 431/354; 431/285
(58) Field of Search ..... 431/328, 326, 431/285, 354, 346, 349, 278, 154; 126/92 R, 92 AC, 92 C, 85 R, 91 R

(56) References Cited

U.S. PATENT DOCUMENTS 1,830,464 A * 11/1931 Guenther ..... 431/285
3,799,452 A * 3/1974 Hein ..... 239/553.3
4,674,973 A * 6/1987 Wright ..... 431/284
5,525,054 A * 6/1996 Nakaura et al. ..... 431/285
5,833,449 A * 11/1998 Knight et al. ..... 431/191
6,746,236 B2 * 6/2004 Kuriyama et al. ..... 431/354

FOREIGN PATENT DOCUMENTS

JP 4-186004 A * 7/1992 ..... F23D/14/08
JP 2001-241617 A * 9/2001 ..... F23D/14/08

* cited by examiner

*Primary Examiner*—Josiah C. Cocks
(74) *Attorney, Agent, or Firm*—Devine, Millimet & Branch; Paul C. Remus; Michelle Saquet Temple

(57) ABSTRACT

A combustion gas burner enabling a multi-stage control including a main casing on the bottom surface of which an air blower is mounted so that air can be supplied from the air blower through an air inlet formed in the lower portion of the main casing, a tube-shaped burner mounted on the main casing in which fire hole units each having a number of fire holes formed at a predetermined distance from one another are disposed on the upper end surface of the main casing in order to burn gas and air which are mixed and supplied to the tube-shaped burner, a plate-shaped burner which is detachably disposed between the fire hole units formed on the upper end surface of the tube-shaped burner, and includes fire hole units having a number of fire holes, a number of mixture supply tubes inserted in the tube-shaped burner and disposed at a predetermined distance so that gas and air are mixed and the mixed gas and air is supplied to the tube-shaped burner and the plate-shaped burner, a Venturi tube installed in front of the mixture supply tubes, mixing gas and air and playing a role of distributing an amount of flow of the mixed gas and air which is needed for independent combustion in each burner, and a manifolder connected to the Venturi tube and the mixture supply tubes, controlling an amount of gas and air. A number of premixed combustion gas burners each having an identical output capacity of the burner, are disposed in parallel with one another and a number of operating burners is varied according to a desired calorie.

5 Claims, 7 Drawing Sheets

COMBUSTION GAS BURNER ENABLING MULTI-STAGE CONTROL

BACKGROUND OF THE INVENTION

1. Field of the Invention

The present invention relates to a combustion gas burner enabling a multi-stage control, and more particularly, to a combustion gas burner enabling a multi-stage control in which a number of premixed combustion gas burners each having an identical burner output capacity, are disposed in parallel with one another and a number of operating burners are varied according to a desired calorie or heat capacity.

2. Description of the Related Art

As is well-known, a boiler for heating and supplying hot water for use in a general home is divided into an oil boiler and a gas boiler according to a fuel used. The oil boiler or the gas boiler uses a burner for burning oil or gas which is used in the boiler.

Thus, a general burner obtains heat by burning fuel safely and efficiently. According to the kind of fuel used, the burner is classified as either a gas burner for combustion of gas, an oil burner for combustion of liquid fuel such as kerosene or diesel oil, or a powdered coal burner for combustion of coal.

Additionally, the burner is divided into a premixed combustion burner and a diffusion combustion burner according to a method for mixing fuel and air. The premixed combustion burner burns fuel and air which have been mixed in advance. The diffusion combustion burner burns mixed fuel and air, the fuel and air are separately supplied to a burner and mixed therein.

Most gas burners widely used as a home gas boiler chiefly adopts the Bunsen gas burner, a diffusion combustion gas burner. The Bunsen gas burner is chiefly used since air can be speedily supplied to heighten the temperature of flames. Thus, the temperature can be raised instantaneously and speedily.

As described above, most gas burners widely used for gas burner equipment such as a home gas boiler employ a Bunsen gas burner. This is because the Bunsen gas burner has a stable flame, thus there is a lower risk of backfire.

However, the Bunsen gas burner has a long flame and a high flame temperature, thus needs more that an theoretical amount of air. Accordingly, there is an increase loss of heat due to high-temperature exhaust gas. This leads to an increased amount of pollutants such as $NO_x$ and CO. As a result, the Bunsen gas burner is somewhat limited in accomplishing maximum efficiency and reduction of pollutants in the gas burner equipment.

The Bunsen gas burner includes a main burner which oversupplies gas and an auxiliary burner which oversupplies air. These are required to easily heighten an instantaneous temperature. Accordingly, the Bunsen gas burner can adjust the intensity and length of the flame.

In the Bunsen gas burner, the main burner is set so that an air surplus ratio is greater than 1.2. The auxiliary burner is set so that an air surplus ratio is smaller than 0.8. In this case, nitrogen oxide of 40 through 60 ppm is discharged, in comparison with the case that nitrogen oxide ($NO_x$) of 120 ppm or so is discharged when the Bunsen gas burner is operated for combustion at a constant air-to-fuel ratio.

Referring not to FIG. 1, a perspective view showing a state of using a conventional Bunsen gas burner is shown. As shown in FIG. 1, the Bunsen gas burner 50 performs a combustion process as follows. Gas is primarily mixed with air 46 supplied by an air blower 42 and the mixture of the gas and air is burned in a combustion unit 45. To assist the combustion unit 45 in performing a combustion process, air 47 is secondarily inhaled into the combustion unit 45 to thereby cause a spread combustion process.

In the case of the spread combustion, the amount of oxygen is lacking and amount of gas is in surplus at the center of the flame. The amount of gas is lacking and oxygen is in surplus at the edge of the flame. Thus, gas and fuel are continuously spread toward the middle portion of the flame according to the difference of in concentration between gas and oxygen. Thus, keeping the fuel and gas burning. Also, part of the carbon monoxide produced at the center of the flame is discharged unless carbon monoxide is oxidized into carbon dioxide during a spread combustion process.

Referring now to FIG. 2, a perspective view showing a conventional Bunsen gas burner is shown. As shown in FIG. 2, the conventional Bunsen gas burner includes a combustion unit in which a plurality of Bunsen burners 10 are arranged in an array with a predetermined distance between them.

Each of the Bunsen burners 10 include an elongate main fire hole unit 11 which is formed of a group of slits which are installed in parallel with each other in the upper portion of the Bunsen gas burner. Also, the Bunsen gas burner 10 includes a flat main burner 1 where an intake hole 12 for inhaling a gas mixture is arranged laterally, and an auxiliary burner 2 where an auxiliary fire hole unit 13 is formed at either side of the main fire hole unit 11 over the whole width of the main fire hole unit 11. Simultaneously a common air intake unit 14 for inhaling a gas mixture is arranged laterally.

In addition, the main burner 1 is formed by pressing on the center position of a metal plate with a group of slits arranged in parallel with each other, forming the main fire hole unit 11, in which an expansion unit 15 is expanded and protruded with respect to the outer side of the main burner, symmetrically with a perpendicular surface including the central line.

Also, an intake hole 12 of inhaling fuel gas and primary air is installed in one side of the expansion unit 15, and a gas flow path 16 connected to the main fire hole unit 11 from the intake hole 12 is formed inside. Also, a cover 4 additionally equipped with a window 3 formed by extending the outer circumferential surface of the auxiliary burner 2 in a cross-linked from, is disposed at the main fire hole unit 11 and the auxiliary fire hole unit 13.

Meanwhile, the window 3 includes a plurality of rectangular windows 17 which open the upper portions of a group of sub-sets of four slits forming the main fire hole unit 11. The window 3 also includes an array of flame holes 18 of a slit shape which partitions the auxiliary fire hole unit 13 with a plurality of flame holes respectively and closes the auxiliary fire hole unit 13 partially.

However, in the case of the conventional Bunsen gas burner, gas sprayed from nozzles 6 in a gas supply tube 5 is supplied to the main burner 1 and the auxiliary burner 2 via the gas flow path 16 of the burner together with the primary air by a sprayed pressure. This is burnt in the upper portions of the main burner 1 and the auxiliary burner 2 to form flames through the main fire hole unit 11 and the auxiliary fire hole unit 13.

Since a plurality of the Bunsen gas burners 10 are connected in a line to form a burner assembly, the overall length of flame is long and the overall temperature of flame is high, thereby increasing a load with respect to an identical area. Further, since gas is burnt via the main fire hole unit 11 in the main burner 1 and the auxiliary fire hole unit 13 in the auxiliary burner 2, an air supply ratio is not controlled sufficiently. Thus, the amount of by-products such as carbon monoxide and nitrogen oxide discharged increases relatively in comparison with the premixed combustion gas burner, which causes an environmental pollution.

In particular, in the case where an existing Bunsen gas burner using a number of Bunsen gas burners 10 in combination for the purpose of high-load combustion, the number of burners becomes large. As a result, it is difficult to control combustion of each burner and the whole size of the burner assembly becomes large.

Meanwhile, a premixed combustion gas burner using knitted metal fiber mat of porous metal fiber weaving tissue as a surface material of a combustion gas burner functions to both reduce polluted materials, such as $NO_x$ and CO, and flame temperature. The knitted metal fiber mat of porous metal fiber weaving tissue, used as a surface material of a combustion gas burner, is woven like a fiber tissue with a metallic material of 50 $\mu$m or less in diameter . This is used as the surface material of the combustion gas burner to both perform perfect combustion of inflammable premixed gas on the combustion surface, and then heat the combustion surface of the gas burner formed of the knitted metal fiber mat of the metal fiber weaving tissue. The combustion heat thereby obtains strong and uniform solid-state radiation energy from the combustion surface of the gas burner.

Additionally, a loss of heat due to exhaust gas is reduced by reducing the amount of excessive air for combustion and lowering the temperature of combustion exhaust gas. This increases thermal efficiency and suppresses polluted materials such as $NO_x$ and CO to be discharged.

Also, a range of a combustion load (a turndown ratio: TDR) is considerably wider than that of the general gas burners whose TDR is 5 to 1. Additionally, the stability of the flame is remarkably superior to that of the general gas burner and employs a simple structure. As described above, the knitted metal fiber mat of porous metal fiber weaving tissue is widely used as a combustion surface material for a gas burner for home use, commercial use and industrial use to enhance thermal efficiency and lower polluted materials in gas combustion equipment.

In particular, materials such as ceramic or stainless steel, and knitted metal fiber mat of porous metal fiber weaving tissue are used as a combustion surface material for a gas burner. Since the knitted metal fiber mat of porous metal fiber weaving tissue has a thermal treatment effect which lowers the temperature of the rear surface of the burner to a value equal to or less than ignition temperature, it is known as a safe material for use with burner flames. This is do to the lower risk of backfiring through small holes on the knitted metal fiber mat of porous metal fiber weaving tissue when the knitted metal fiber mat is used as the combustion surface material of the gas burner in order to perform combustion of the premixed gas.

Also, the gas burner using knitted metal fiber mat of porous metal fiber weaving tissue has an advantage of having no need to specially countermeasure a backfire phenomenon, which is used to reduce polluted materials such as $NO_x$ and CO and lower the temperature of flames.

However, in the case that the temperature of flames is low in the conventional premixed combustion gas burner, the burner flames may be unstable. This can lead to increased production cost, and it may be difficult to fabricate it. Also, it may be more difficult to stably control combustion of the premixed gas in home gas burner equipment, which has a simple structure design.

Also, in the case that ceramic, stainless steel, or knitted metal fiber mat of porous metal fiber weaving tissue is used as a combustion surface material of the premixed combustion gas slits, a premixer for premixing fuel gas and air may become large and somewhat complicated. As a result, air blowing resistance increases due to a loss of pressure in the premixer. This may lead to abnormal noise at part of a high-load region during combustion or main flames of the gas burner may be unstable.

As described above, if a mixing chamber which is an additional unit for mixing fuel gas and air and supplying the mixture is used in the conventional premixed combustion gas burner, the structure becomes complicated and it is difficult to set a mixing ratio of fuel gas and air into an appropriate value.

In particular, it is impossible to apply the mixing chamber to a burner performing a multi-stage control.

SUMMARY OF THE INVENTION

To solve the above problems, it is an object of the present invention to provide a combustion gas burner enabling a multi-stage control in which a number of premixed combustion gas burners each having an identical burner output capacity are disposed in parallel with one another and a number of operating burners are varied according to a desired calorie, to thereby make it easy to change a design of the burner.

It is another object of the present invention to provide a combustion gas burner enabling a multi-stage control through a manifolder structure having a simple structure having no mixing chamber for mixing gas and air, in which flow paths through which gas and air flow independently, exist in the manifolder of the combustion gas burner enabling a multi-stage control and thus a mixture of gas and air is not produced in the manifolder, to thereby provide a simple structure, make it easy to control an amount of gas and an amount of air in order to supply the amount of gas and the amount of air necessary for a rating output of the premixed combustion gas burner always at a constant ratio and maintain a combustion efficiency, to thus maintain the output of the premixed combustion gas burner to be consistent.

As described above, the present invention provides a premixed combustion gas burner enabling a combustion operation in a premixing style, and thus reduces the total length of flames and lowers the temperature of flames relatively in comparison with the conventional Bunsen gas burner, and also reduces an amount of polluted materials such as carbon monoxide and nitrogen oxide to provide an anti-pollution burner and enable a high-load burner assembly smaller than the conventional Bunsen gas burner to be easily fabricated.

To accomplish the above object of the present invention, there is provided a combustion gas burner enabling a multi-stage control comprising: a number of premixed combustion gas burners including a number of tube-shaped burners and a number of plate-shaped burners each having an identical burner output capacity which are disposed in parallel with one another in which a number of operating burners are varied according to a desired calorie.

Preferably, the combustion gas burner enabling a multi-stage control comprises: a main casing on the bottom surface of which an air blower is mounted so that air can be supplied from the air blower through an air inlet formed in the lower portion of the main casing; at least one tube-shaped burner mounted on the main casing in which fire hole units each having a number of fire holes formed at a predetermined distance from one another are disposed on the upper end surface of the main casing in order to burn gas and air which are mixed and supplied to the tube-shaped burner; at least one plate-shaped burner which is detachably disposed between the fire hole units formed on the upper end surface of the tube-shaped burner, and includes fire hole units having a number of fire holes; a number of mixture supply tubes inserted in the tube-shaped burner and disposed at a predetermined distance so that gas and air are mixed and the mixed gas and air is supplied to the tube-shaped burner and the plate-shaped burner; a Venturi tube installed in front of the mixture supply tubes, mixing gas and air and playing a role of distributing an amount of flow of the mixed gas and air which is needed for independent combustion in each burner; and a manifolder connected to the Venturi tube and the mixture supply tubes, controlling an amount of gas and air.

BRIEF DESCRIPTION OF THE DRAWINGS

The above and other objects and advantages of the present invention will become more apparent by describing the preferred embodiment thereof in detail with reference to the accompanying drawings in which.

DETAILED DESCRIPTION OF THE INVENTION

Figure 1:
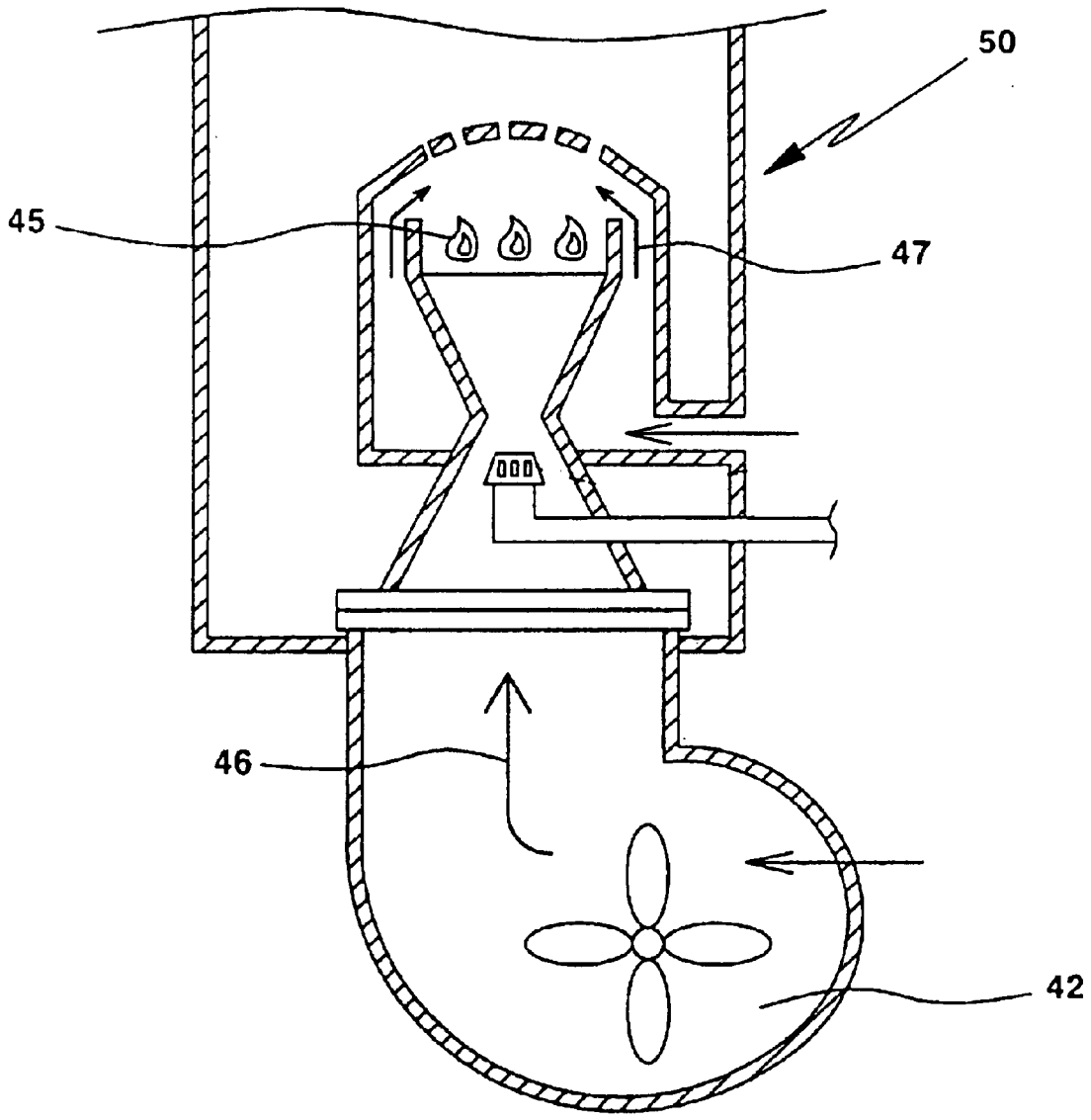
FIG. 1 PRIOR ART
FIG. 1 schematically shows a state of use of a conventional Bunsen gas burner.
Figure 2:
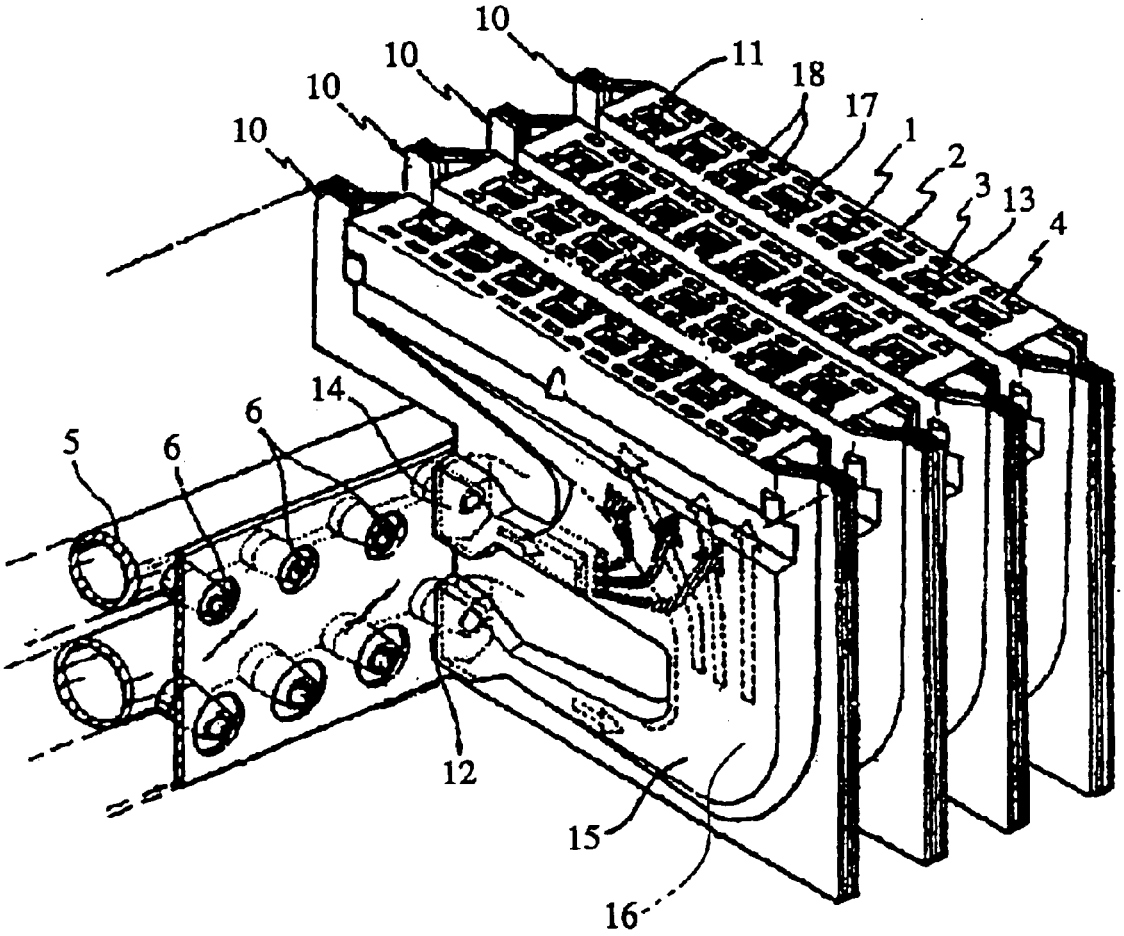
FIG. 2 PRIOR ART
FIG. 2 is a perspective view showing a conventional Bunsen gas burner.

A combustion gas burner enabling a multi-stage control according to a preferred embodiment of the present invention will be described below with reference to the accompanying drawings.

Referring to FIGS. 3 through 10, a combustion gas burner 100 enabling a multi-stage control includes a number of premixed combustion gas burners. These include at least one tube-shaped burner 20 and at least one plate-shaped burner 30, each having an identical burner output capacity. The burners 20, 30 are disposed in parallel with one another in which a number of operating burners are varied according to a desired calorie.

Preferably, the combustion gas burner 100 enabling a multi-stage control includes a main casing 10, at least one tube-shaped burner 20, at least one plate-shaped burner 30, a number of mixture supply tubes 40, a Venturi tube 60, and a manifolder 80.

An air blower 50 is mounted on the bottom surface of the main casing 10 so that air can be supplied from the air blower 50 through an air inlet 11 formed in the lower portion of the main casing 10. The tube-shaped burner 20 is mounted on the main casing 10 in which fire hole units 21, each having a number of fire holes formed at a predetermined distance from one another, are disposed on the upper end surface of the main casing 10. The fire hole units 21 are there to burn gas and air, which are mixed and supplied to the tube-shaped burner 20.

The plate-shaped burner 30 is detachably disposed between the fire hole units 21 formed on the upper end surface of the tube-shaped burner 20, and includes fire hole units 31 having a number of fire holes.

The number of mixture supply tubes 40 are inserted in the tube-shaped burner 20 and disposed at a predetermined distance so that gas and air are mixed and the mixed gas and air is supplied to the tube-shaped burner 20 and the plate-shaped burner 30.

The Venturi tube 60 is installed in front of the mixture supply tubes 20. The Venturi tube 60 mixes gas and air and plays a role in distributing an amount of flow of the mixed gas and air which is needed for the independent combustion in each burner.

The manifolder 80 is connected to the Venturi tube 60 and the mixture supply tubes 40, controls the amount of gas and air.

A partition 13 partitioning between the air blower 50 mounted on the bottom of the main casing 10 and the tube-shaped burner 20, is formed at a distance from the bottom surface of the main casing 10. Also, the tube-shaped burner 20 is loaded over the partition 13.

As described above, the premixed combustion gas burner formed of the tube-shaped burner 20 and the plate-shaped burner 30 is disposed on the partition 13 provided in the main casing 10.

When the plate-shaped burner 30 is mounted in the tube-shaped burner 20, a cooling water tube 70 through which water circulates to cool the burner is provided. The cooling water tube 70 prevents deformation such as buckling from occurring.

The plate-shaped burner 30 is simply fitted into the loader 22 of the tube-shaped burner 20. In this case, the water tube 70 penetrates the insertion hole 12 formed in the lateral surface of the main casing 10 and fitted into a fitting hole 23 formed in the lateral surface of the tube-shaped burner 20. A fitting hole 33 formed in the pin structure 32 is formed on the bottom surface of the plate-shaped burner 30 in correspondence to the fitting hole 23 formed in the tube-shaped burner 20. Thus, they firmly fix the tube-shaped burner 20 and the plate-shaped burner 30. As a result, water circulating along the water tube 70 can cool the overheated burner simultaneously.

In other words, since the cooling water tube 70 penetrates the pin structure 32 formed in the lower end of the plate-shaped burner 30, heat generated in the upper fire hole unit 31 is discharged through the pin structure 32 although the burner is overheated. In this case, water is supplied through the cooling water tube 70 to cool the burner. As a result, the premixed combustion gas burner according to the present invention has a merit that deformation such as buckling, due to thermal tension caused by overrunning the burner, is avoided.

Also, if the temperature of the flames is reduced through a cooling function of the cooling water circulating through the water tube 70, a greater amount of the nitrogen oxide generated can be reduced. Thus, this prevents damage by a fire due to heat cumulated on the burner surface.

In particular, the cooling water tube 70 plays a role of fixing the tube-shaped burner 20 and the plate-shaped burner 30. This occurs when the plate-shaped burner 30 is mounted in the loaders 22 of the tube-shaped burner 20.

As described above, the mixture supply tubes 40 inserted and mounted into the tube-shaped burner 20 are provided in the front surface of the tube-shaped burner 20. The mixture supply tubes 40 play a role of mixing gas and air and supplying the mixture to the burner as described above. They also supplement a demerit that the conventional premixed combustion gas burner should include a separate mixing chamber. In the mixture supply tubes 40, gas and air are supplied through separate paths simultaneously and then mixedly supplied to the burner at the state where gas and air are mixed while passing through the mixture supply tubes 40.

As described above, the Venturi tubes 60 play the role of mixing gas and air and distributing the mixed flow amount needed for combustion of the burner. The independent supply to each burner is installed on the front surface of the mixture supply tubes 40.

Thus, since gas and air are mixed through the mixture supply tubes 40 and the Venturi tubes 60 during inflow of gas and air and the mixture is supplied to the burner in the present invention, a separate mixing chamber which is required in the conventional premixed combustion gas burner is not needed. Therefore, secondary air need not be supplied to the burner in the present invention, which is a typical premixed combustion gas burner.

Also, a manifolder 80 through which air and gas can be supplied is provided in front of each of the Venturi tubes 60 in the combustion gas burner. The manifolder 80 enables a multi-stage control having the above-described structure.

As shown in FIGS. 6 through 9, the manifolder 80 structure includes a gas supply path 82 supplying gas and an air supply path 83 supplying air. These are both independently disposed in a single body 81. Additionally, a cover 84 covering the front surface of the body 81 is provided in front of the body 81.

Thus, the manifolder 80 according to the present invention includes a protruded body 81 so that a substantially rectangular plate-shaped material is worked to form a predetermined space. Also, a number of nozzles form the gas supply paths 82 that supply gas are disposed on the body 81 at a distance from each other. A number of air supply paths 83 through which air is supplied from an air blower 50, to be described later, passes are formed on the inner surface of the body 81 which oppose the nozzles 86.

Here, the gas supply path 82 in the nozzle 86 has a structure allowing the gas to flow from bottom to top, and the air supply path 83 has a structure allowing the air inhaled from the air blower 50 to collide to the inner side of the body 81, and then to then flow toward the Venturi tube 60. A gas control valve (not shown) supplying gas is located at a gas inlet 85 in the gas supply path 82, and the inlet of the air supply path 83 communicates with the air blower 50.

In particular, two gas inlets 85 for the gas supply path 82 are formed in the manifolder 80 shown in FIGS. 6 through 9 . These FIGS. show that two gas control valves (not shown) are connected to two gas inlets 85, which are independently controlled and thereby embody a two-stage control.

The number of the gas inlets 85 can be increased as necessary. In this case, the nozzles 86 for the gas supply paths 82 are correspondingly divided according to the number of the gas inlets 85. Thus, they supply the inhaled gas to the Venturi tube 60 and the mixture supply tubes 40 via the respective independent paths.

As described above, increasing the number of the gas inlets 85 through which gas is inhaled means that a two-or-more-stage control can be performed. Additionally, the nozzles 86 for the gas supply paths 82 and the outlets for the air supply paths 83 are in the form of an independent path connected to the Venturi tube 60 and the mixture supply tubes 40 of the combustion gas burner. Thus, this arrangement allows control of the amount of gas and air as desired. The nozzles 86 are formed in a one-to-one corresponding structure with respect to the Venturi tube 60 and the mixture supply tubes 40.

As described above, the manifolder 80 is provided so that air and gas can be supplied via an independent path respectively in the combustion gas burner enabling a multi-stage control. The Venturi tube 60 and the mixture supply tubes 40, which play a role of mixing air and gas and distributing an amount of flowing gas and air for combustion, are installed in association with the manifolder 80. Accordingly, an additional mixing chamber for mixing air and gas is not needed in the present invention. Thus, in the present invention, gas is supplied from gas control valves (not shown) connected toward the gas inlets 85 which are installed closely below the nozzles 86 in the manifolder 80.

As described above, the gas control valve in the manifolder 80 supplies gas supplied via the gas inlets 85 to the Venturi tube 60 via the nozzles 86 which are the gas supply paths 82. The air supplied from the air blower 50 flows through the air supply path 83 along the inner surface of the body 81 which is the outer surface of the nozzles 86. Accordingly, at the state where mixture produced by mixing air and gas is not produced in the manifolder 80, gas and air is individually sent to the Venturi tube 60, and the air and gas having passed through the Venturi tube 60 are mixed in the mixture supply tube 40, to then be supplied to the burner in the form of the mixture.

Figure 4:
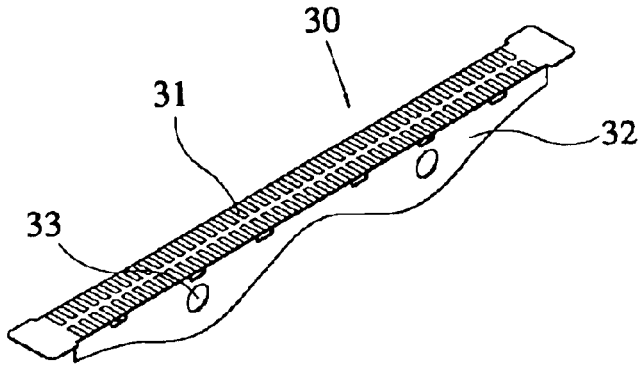
FIG. 4 is a perspective view showing a tube-shaped burner constituting a combustion gas burner according to the present invention.
Figure 5:
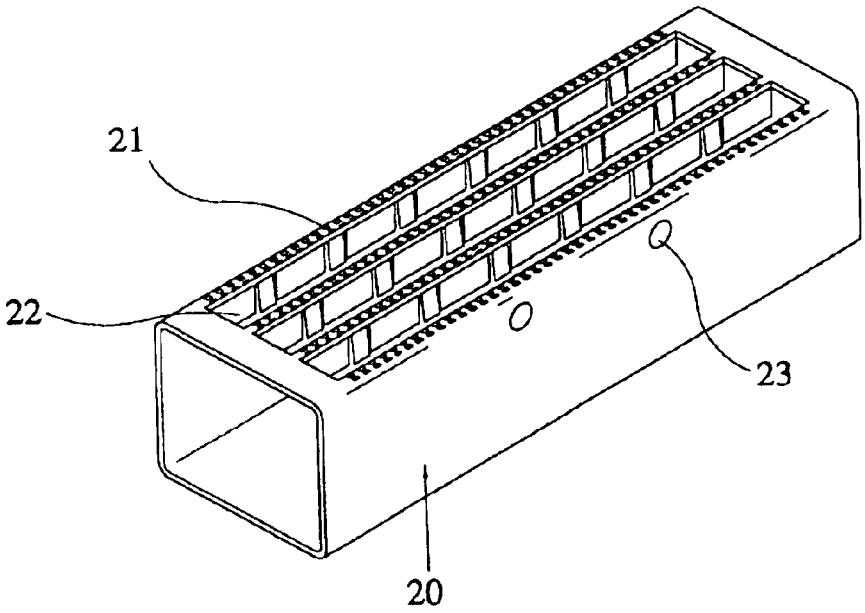
FIG. 5 is a perspective view showing a plate-shaped burner constituting a combustion gas burner according to the present invention.
Figure 6:
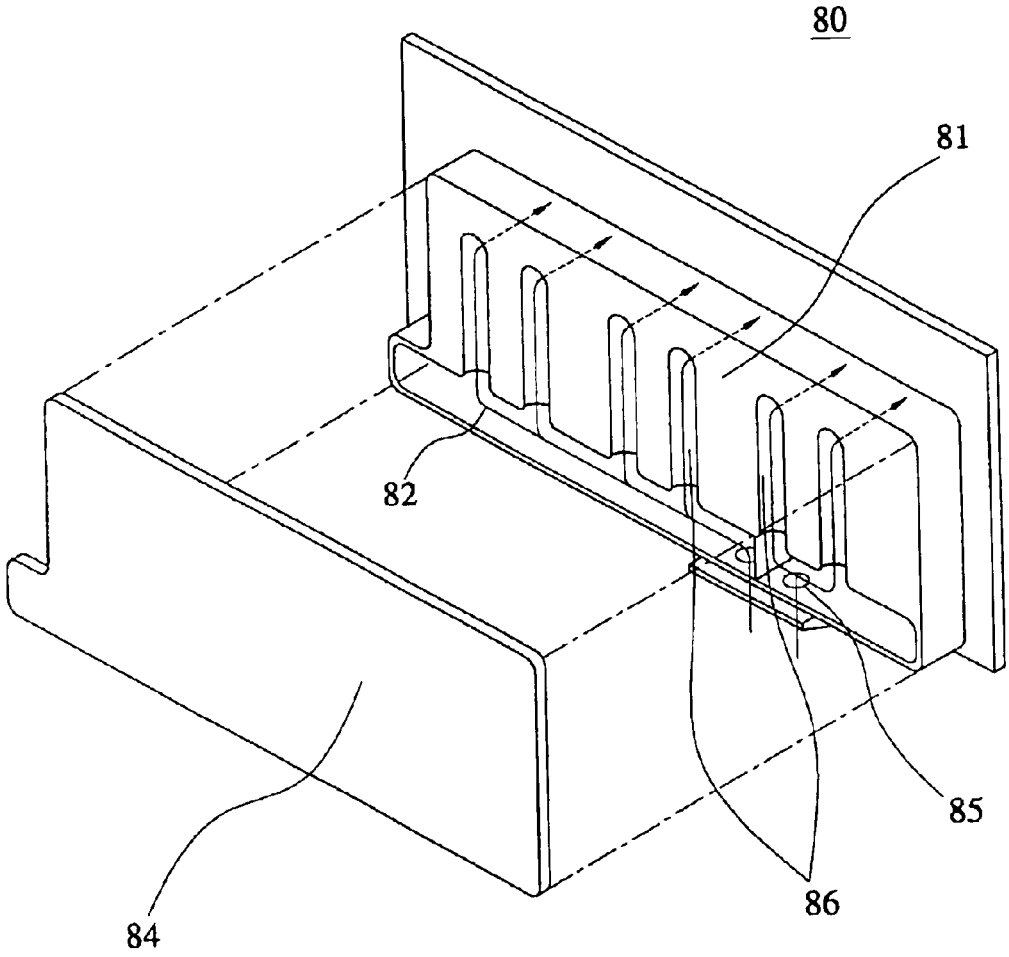
FIG. 6 is a front-surface perspective view showing the structure of a manifolder according to the present invention.
Figure 7:
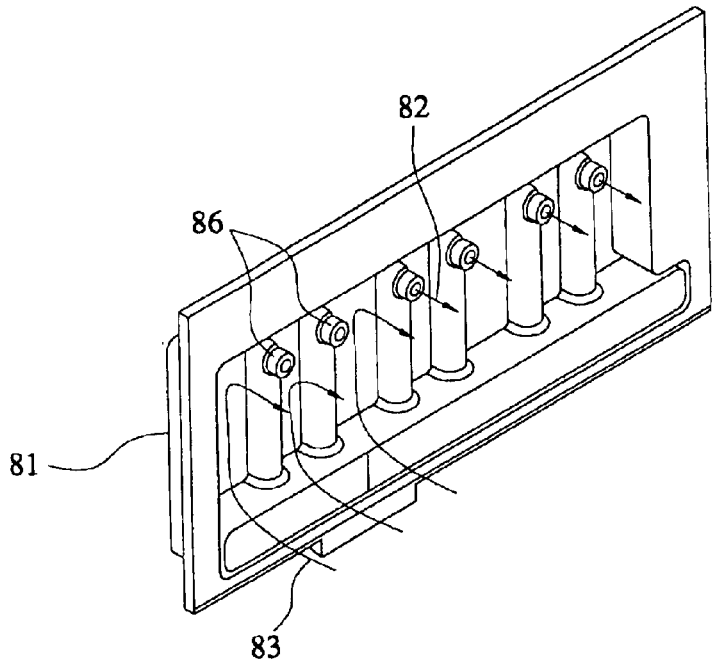
FIG. 7 is a rear-surface perspective view showing the structure of a manifolder according to the present invention.
Figure 8:
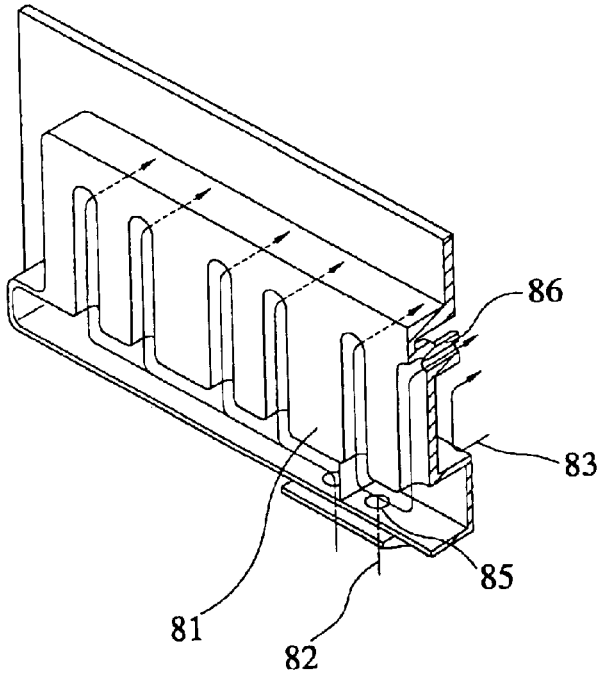
FIG. 8 is a partially broken perspective view showing a portion for supplying gas in the manifolder according to the present invention.
Figure 9:
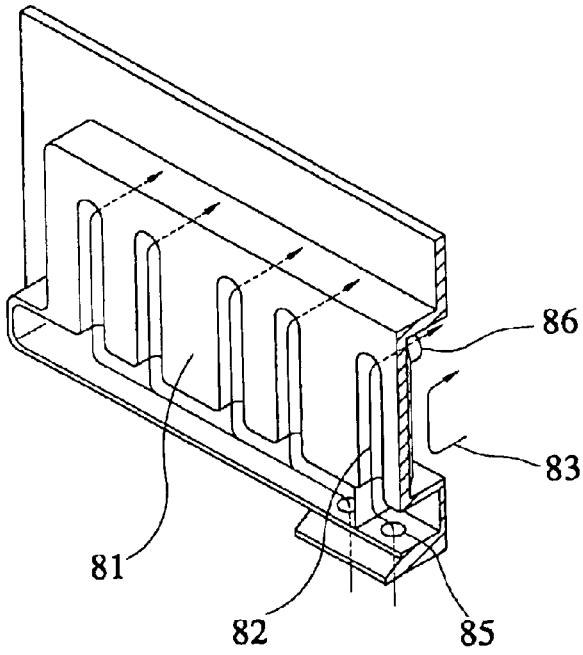
FIG. 9 is a partially broken perspective view showing a portion for supplying air in the manifolder according to the present invention.
Figure 10:
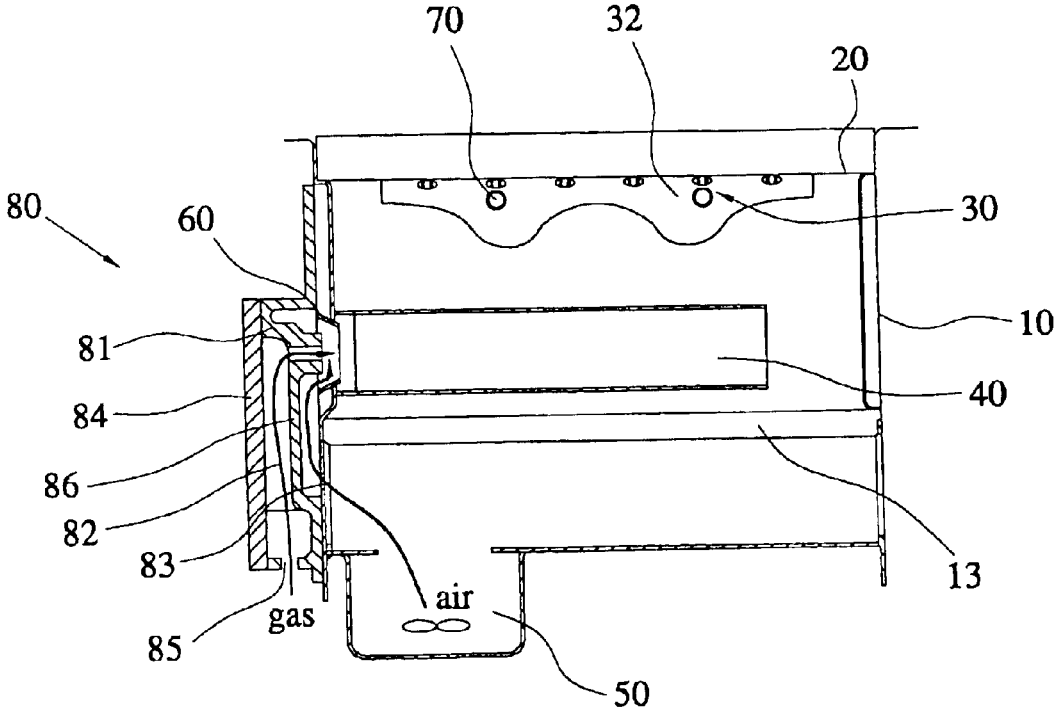
FIG. 10 is a cross-sectional view showing an assembly state of the combustion gas burner according to the present invention.

The structures of the tube-shaped burner 20 and the plate-shaped burner 30 among the combustion gas burner enabling a multi-stage control will be described in detail with reference to FIGS. 4 and 5.

As described above, the combustion gas burner 100 enabling a multi-stage control includes a tube-shaped burner 20 having fire hole units 21. Each fire hole unit 21 having a number of fire holes formed at a predetermined distance from one another and disposed on the upper end face for burning gas and air which are supplied in a mixed state. The combustion gas burner 100 also includes a plate-shaped burner 30 which is detachably disposed in loaders 22 formed between the fire hole units 21 formed on the upper end of the tube-shaped burner 20, in which fire hole units 31 having a number of fire holes are disposed, to thereby separate all the fire hole units.

The tube-shaped burner 20 according to the present invention has an open front face and inner portion of a hollow tubular shape. Fire hole units 21, each having a number of fire holes formed with a uniform size at a predetermined distance from one another, are disposed in both edge lines and the inner portion on the upper end face. Loaders 22 are formed between the fire hole units 21 which mount the plate-shaped burner 30 between the fire hole units 21 in turn. The tube-shaped burner 20 is formed by a number of tubular burners connected in parallel with one another in units of a single tubular shape. A plurality of fitting holes 23 through which a cooling water tube 70 is fitted and which is fixedly connected with the plate-shaped burner 30, are formed at a predetermined distance on the lateral surface of the tube-shaped burner 20.

The plate-shaped burner 30 mounted on loaders 22 formed in the tube-shaped burner 20 is a burner made of a plate-shaped material on which a protruding pin structure 32 is formed with a predetermined curvature. That is, the plate-shaped burner 30 has a structure that fire hole units 31 are disposed along both edge lines on the upper surface of the plate-shaped material, in which each fire hole unit has a number of fire holes at a predetermined distance in the form of a slit of a uniform size, like the tube-shaped burner 20.

Figure 3:
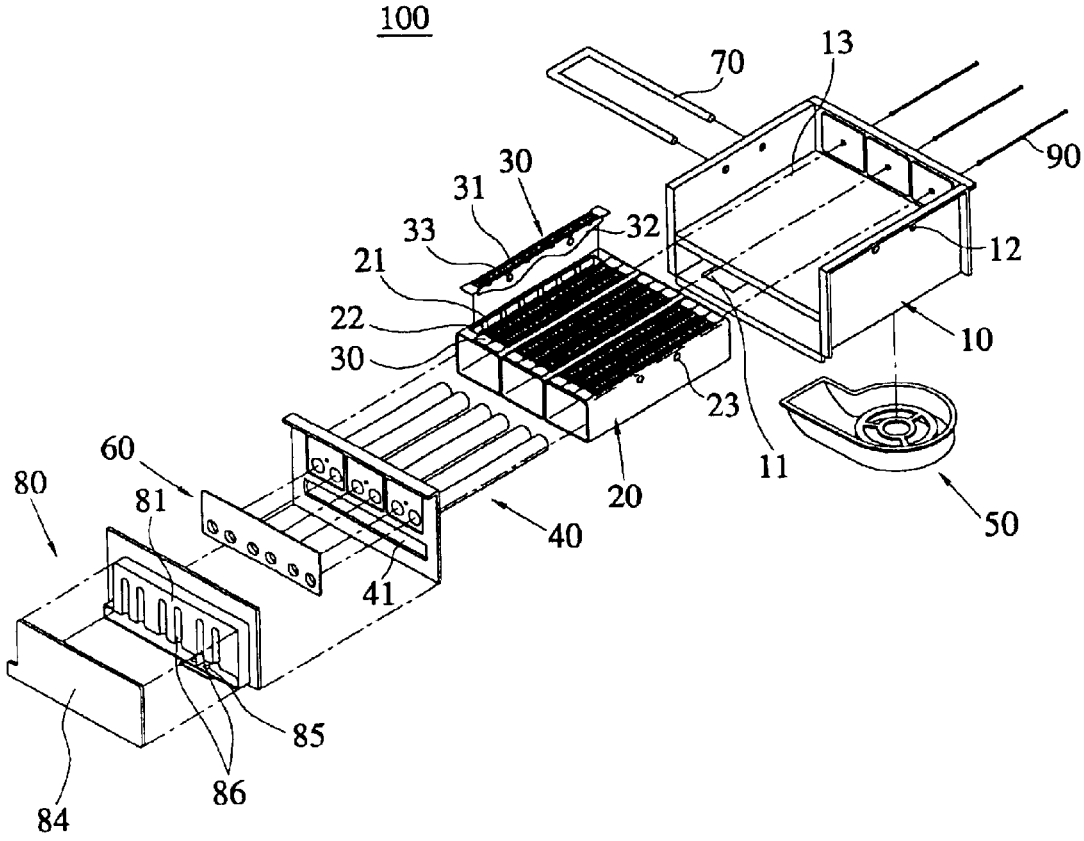
FIG. 3 is an exploded perspective view showing the whole configuration of a combustion gas burner according to the present invention.

Fitting holes 33 formed on the pin-structure 32 formed on the bottom of the plate-shaped burner 30, through which a cooling water tube 70 of FIG. 3 can penetrate, are formed in correspondence to the fitting holes 23 of the tube-shaped burner 20. In particular, fire hole units 21 and 31 each have a number of fire holes formed in the tube-shaped burner 20 and the plate-shaped burner 30 having a uniform performance in a single burner because each fire hole is uniformly formed by a press. Thus, the tube-shaped burner 20 and the plate-shaped burner 30 having the above-described structures constitute a single premixed combustion gas burner in which the plate-shaped burner 30 is mounted on the loaders 22 of the tube-shaped burner 20.

The fire hole unit 21 of the tube-shaped burner 20 is located in the middle of the plate-shaped burners 30, and the fire hole unit 21 of the tube-shaped burner 20 makes flames easily transmitted between the plate-shaped burners 30. When the tube-shaped burners 20 are connected in parallel with one another, the leftmost and rightmost fire hole units 21 play a role of easily transmitting flames between the tube-shaped burners 20.

Here, as shown in FIG. 3, the combustion gas burner 100, including the tube-shaped burner 20 and the plate-shaped burner 30 according to the present invention having the above-described structure, employs a structure of performing a multi-stage control of a burner. The premixed combustion gas burners each include several tube-shaped burners 20 and several plate-shaped burners 30 whose output capacity is identical. The tube-shaped burners 20 and plate-shaped burners 30 are disposed in parallel with one another to thereby perform a combustion operation by varying the number of burners according to a desired heat capacity.

The combustion gas burner enabling a multi-stage control according to the present invention has a structure of a typical premixed combustion gas burner and thus has merits of the conventional premixed combustion gas burner. Thus, the present invention both reduces the length of the flames and lowers the temperature of the flames, thereby reducing the load for an identical area and reduce production of pollutant materials such as carbon monoxide and nitrogen oxide at minimum.

Additionally, the premixed combustion gas burner with the tube-shaped burner 20 and the plate-shaped burner 30, which can be easily separated from each other, can be easily fabricated into a high-load burner assembly having a relatively smaller size than the conventional Bunsen and premixed combustion gas burner. Further, the number of operating burners can be varied according to a desired heat capacity to provide a structural feature with design modification facilitates.

Referring next to FIG. 3, an embodiment of the combustion gas burner of the present invention showing a state where three premixed combustion gas burners are disposed in parallel with one another. However, the present invention is not limited thereto, but it is apparent that the number of operating burners can be varied according to a desired heat capacity even at the state where a number of premixed combustion gas burners are disposed in parallel with one another.

In particular, the output of the burner is influenced by the number of plate-shaped burners having a number of fire hole units which are disposed in the plate-shaped burners. Thus, the heat capacity of the burners can be easily changed according to the number and size of the plate-shaped burners.

Also, since the combustion gas burner 100 according to the present invention mixes gas and air during the time when the gas and air are inhaled through the mixture supply tubes 40 and the Venturi tube 60, a separate mixing chamber which is needed in the conventional premixed combustion gas burner is not needed. Thus, the present invention provides a typical premixed combustion gas burner having no need to be supplied with secondary air which has been needed in the conventional premixed combustion gas burner.

In particular, in the case of the mixture supply tubes 40 shown in FIG. 3 as an embodiment of the present invention, two mixture supply tubes are connected to a single tube-shaped burner 20 as a group. Also, a Venturi tube 60 is installed in correspondence to six mixture supply tubes 40. Gas and air supplied to the Venturi tube 60 are supplied through the respectively independent supply lines. Thus, when a multi-stage control is needed, a multi-stage control such as a two-stage control or a three-stage control can be realized according to the design paths through which gas and air are supplied independently.

Reference numeral 90 in FIG. 3 denotes a tension bolt. The tension bolt 90 penetrates from the rear surface of the main casing 10 over the front surfaces of the mixture supply tubes 40 and assembles the main casing 10 and the mixture supply tubes 40 firmly with one another. A reference numeral 41 denotes an inhaled air outlet 41 provided in the lower end of the front surface of the mixture supply tubes 40 for discharging the air inhaled through the air blower 50.

As described above, the present invention provides a combustion gas burner enabling a multi-stage control in which a number of premixed combustion gas burners, each having an identical burner output capacity, are disposed in parallel with one another. The number of operating burners are varied according to a desired calorie, thereby making it easy to change the design of the burner.

Also, as described above, the present invention provides a very useful and efficient premixed combustion gas burner enabling a combustion operation in a premixing style, and thus reduces the total length of flames and lowers the temperature of flames relatively in comparison with the conventional Bunsen gas burner. The present invention also reduces the amount of pollution materials such as carbon monoxide and nitrogen oxide to provide an anti-pollution burner. Additionally, the present invention enables easy fabrication of a high-load burner assembly smaller than the conventional Bunsen gas burner.

Also, the present invention provides a combustion gas burner enabling a multi-stage control through a manifolder structure having a simple structure without a mixing chamber for mixing gas and air. Flow paths, through which gas and air flow independently, exist in the manifolder of the combustion gas burner enabling a multi-stage control and thus a mixture of gas and air is not produced in the manifolder. Also, the Venturi tube and mixture supply tubes play the role of mixing gas and air and distributing an amount of flow necessary for combustion.

Accordingly, the present invention solves the problems of the conventional premixed combustion gas burner which requires the existing mixing chamber. Thus, the present invention makes it easy to control the amount of gas and the amount of air in order to supply the amount of gas and the amount of air necessary for a rating output of the premixed combustion gas burner. This allows the amount of gas and air to be always at a constant ratio and thus maintaining a combustion efficiency, thereby consistently maintaining the output of the premixed combustion gas burner.

In particular, the manifolder according to the present invention has a simple structure that does not need a mixing chamber for mixing gas and air, and is a very useful and efficient apparatus that supplies gas and air in the premixed combustion gas burner realizing a multi-stage control.

What is claimed is:

1. A combustion gas burner enabling a multi-stage control comprising:

a main casing on a bottom surface of which an air blower is mounted so that air can be supplied from the air blower through an air inlet formed in a lower portion of the main casing;

at least one tube-shaped burner mounted on the main casing having fire hole units, each of the fire hole units having a number of fire holes formed at a predetermined distance from one another, and being disposed on an upper end surface of the main casing in order to burn gas and air which are mixed and supplied to the tube-shaped burner;

at least one plate-shaped burner detachably disposed between the fire hole units formed on the upper end surface of the tube-shaped burner, the plate-shaped burner includes fire hole units having a number of fire holes;

a number of mixture supply tubes inserted in the tube-shaped burner and disposed at a predetermined distance so that gas and air are mixed and the mixed gas and air is supplied to the tube-shaped burner and the plate-shaped burner;

a Venturi tube installed in front of the mixture supply tubes, mixing gas and air and playing a role of distributing an amount of flow of the mixed gas and air which is needed for independent combustion in each burner; and a manifolder connected to the Venturi tube and the mixture supply tubes, controlling an amount of gas and air.

2. The combustion gas burner enabling a multi-stage control of claim 1, further comprising a number of premixed combustion gas burners including at least one tube-shaped burner and at least one plate-shaped burner, each having an identical burner output capacity, disposed in parallel with one another and wherein a number of operating burners are varied according to a desired calorie.

3. The combustion gas burner enabling a multi-stage control of claim 1, wherein the manifolder has no mixing chamber for mixing gas and air, and wherein the manifolder having flow paths through which gas and air flow independently, and thus a mixture of gas and air is not produced in the manifolder.

4. The combustion gas burner enabling a multi-stage control of claim 3, wherein the manifolder comprising:

a body protruding to form a predetermined space by working a general plate-shaped material;

a cover covering a front surface of the body provided in front of the body;

gas inlets supplying gas provided on the body;

a number of nozzles formed of gas supply paths supplying gas disposed on the body at a distance from each other; and a number of air supply paths, through which air passes, formed on the inner surface of the body which oppose the nozzles.

5. The combustion gas burner enabling a multi-stage control of claim 4, wherein the number of the gas inlets supplying gas which are provided on the body corresponds to the number of control stages, and the nozzles are separately partitioned to form respectively independent gas supply paths in correspondence to the number of multiple stages to control.

* * * * *